US005184395A

United States Patent [19]

Pan et al.

[11] Patent Number: 5,184,395

[45] Date of Patent: Feb. 9, 1993

[54] SYSTEM FOR MANUFACTURING PERMANENT MAGNETIC FIELD GENERATORS AND RELEVANT MAGNET GEOMETRIES THEREFOR

[75] Inventors: Antonio Pan; Paolo Pan, both of Crema; Franco Bertora, Genoa, all of Italy

[73] Assignee: Comec S.R.L., Italy

[21] Appl. No.: 545,368

[22] Filed: Jun. 28, 1990

[30] Foreign Application Priority Data

Jul. 3, 1989 [IT] Italy ..... 21079 A/89

[51] Int. Cl.[5] ..... H01F 7/06

[52] U.S. Cl. ..... 29/609; 335/306

[58] Field of Search ..... 29/607, 609; 335/306

[56] References Cited

U.S. PATENT DOCUMENTS

| | | | |
|---|---|---|---|
| H591 | 3/1989 | Leupold | 29/607 |
| 3,875,660 | 4/1975 | Kobayashi et al. | 29/609 |
| 4,647,887 | 3/1987 | Leupold | 335/306 |
| 4,893,103 | 1/1990 | Leupold | 335/306 |
| 4,999,600 | 3/1991 | Aubert | 335/306 |

FOREIGN PATENT DOCUMENTS

| | | | |
|---|---|---|---|
| 513395 | 5/1976 | U.S.S.R. | 335/306 |

*Primary Examiner*—P. W. Echols

*Attorney, Agent, or Firm*—Ostrolenk, Faber, Gerb & Soffen

[57] ABSTRACT

A process for the manufacture of magnetic field generators including the steps of: marking at least one tile made of conventional material with an identification code; cutting each marked tile into n strips having two dimensions and A—A axis orientation same as the initial tile; rotating the strips 90° to obtain rotated strips having a second A—A axis orientation; selecting and rearranging the rotated strips to obtain the desired characteristics of symmetry and compensation of the magnetic characteristic variations of the input tiles; assembling the rotated strips to form a new tile with different A—A axis orientation; cutting the assembled tiles into portions or sections of predetermined geometric shape; magnetizing the sections; assembling a set of these sections into magnet forming elements; tuning the magnet forming elements; assembling the elements to obtain finished magnets; and tuning the finished magnets.

9 Claims, 10 Drawing Sheets

Fig. 2d
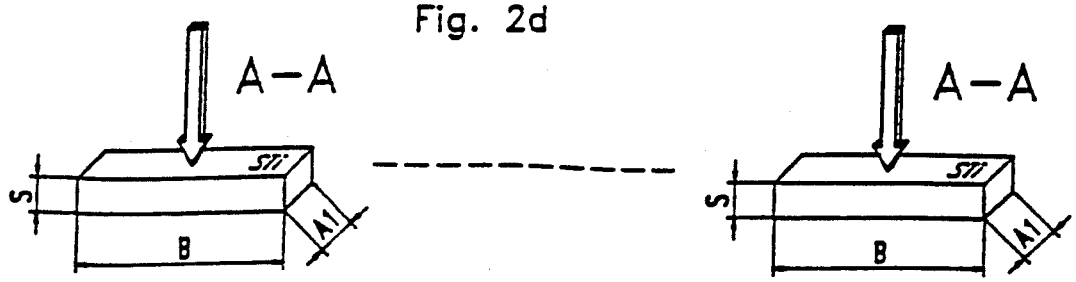
Fig. 2e
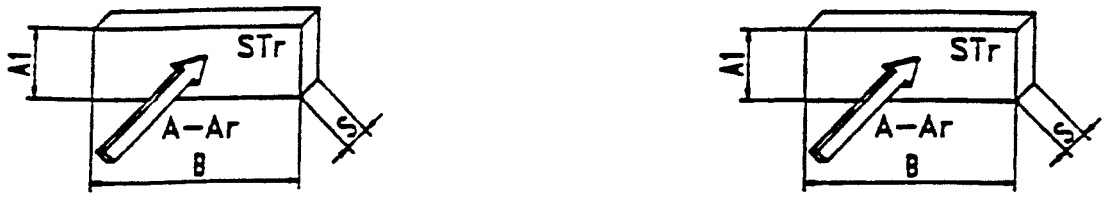
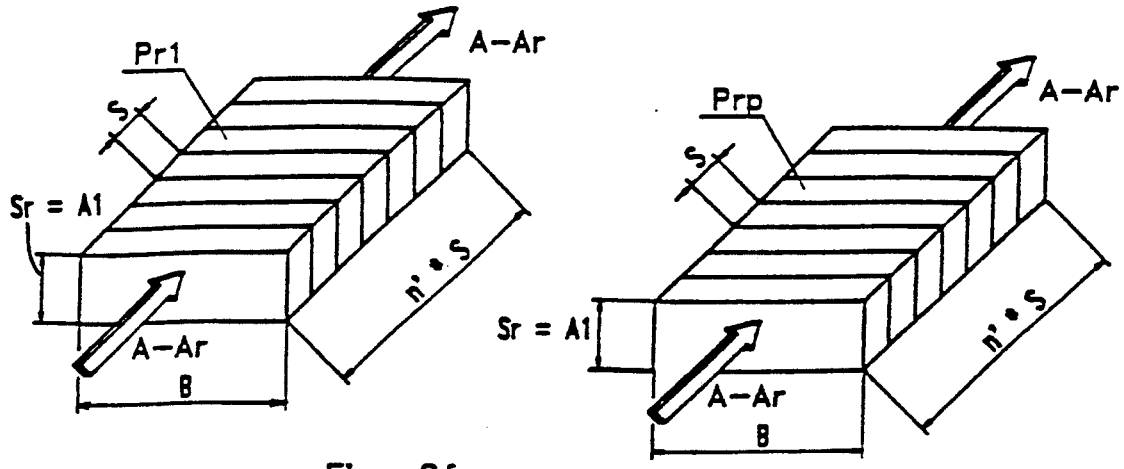
Fig. 2f

SYSTEM FOR MANUFACTURING PERMANENT MAGNETIC FIELD GENERATORS AND RELEVANT MAGNET GEOMETRIES THEREFOR

BACKGROUND OF THE INVENTION

1. Field of the Invention

The present invention relates to a system for the manufacture of field generators (MF), including a method of cutting and arranging tiles of magnetic material to obtain designated shapes for assembly into magnet forming elements (EFM). The invention also relates to magnet geometries obtained using the magnet forming elements.

2. Description of the Related Art

The theoretical basis for calculating the structure of elements made of permanent magnetic material that are used in obtaining uniform magnetic fields, has been recently developed. See M. G. Abele, Technical Reports, New York University School of Medicine. E.g. NYU-TR 13, NYU-TR 14, NYU-TR 15 and NYU-TR 21.

These structures are of fundamental importance in a wide range of applications ranging from electronics to medicine. However, an essential condition in the realization of such structures is the availability of prismatic magnetized elements with designated thickness, shape and direction of the A—A axis. In particular, to obtain magnets of usable dimensions, it is imperative to obtain magnetic material elements with their A—A axis oriented along one of the major dimensions.

The method presently used in the production of materials suitable for the manufacture of permanent magnets yields blocks or tiles of magnetic material having their anisotropy axis oriented along a minor dimension such as thickness. This approach, together with other imperfections in the material, imposes a limitation on the realization of structures such as described above.

The aforementioned imperfections result from non-uniformities in the magnetic properties of the magnetic material. The imperfections appear as variations in magnetic material characteristics from one tile to another. The practical effect of these imperfections is that errors and dissymmetries are introduced in the magnetic system resulting in field non-uniformities that add to those arising from the geometry of the system.

SUMMARY OF THE INVENTION

Accordingly, it is an object of the present invention to provide a process for producing magnetic field generators using conventional magnetic tiles, thereby overcoming the obstacles and drawbacks of the presently used technologies.

Another object of the invention is to provide tiles, sections, magnet forming elements and finished magnets using the above method.

A still further object of the invention is to provide magnet structural geometries using the products manufactured according to the invention.

The foregoing and other objectives are achieved by a process for the manufacture of magnetic field generators wherein tiles of magnetic material are cut and rearranged to obtain magnet forming elements EFM. In one embodiment, parallelepipedal shaped tiles Pc of magnetic material with dimensions, length A, width B, thickness S and the A—A axis perpendicular to the major surface A-B and parallel to S, are used.

The tiles Pc are marked with an identifiable code in the first step MA. The marked tiles are then cut into strips. In the preferred embodiment, each tile Pc is cut into n strips; each strip retains the same width, thickness, and orientation of the A—A axis of the tile Pc, from which it is obtained.

In the next step, the strips are rotated; in the preferred embodiment the rotation is 90° around an axis perpendicular to the A—A axis thereby obtaining rotated strips STr having orientation A-Ar. The rotated strips STr are selectively rearranged to achieve desired characteristics of symmetry, and compensation for magnetic characteristic variations in the input tiles Pc. These selected and rearranged strips are then assembled by a method such as gluing to form new tiles Pr having an orientation A-Ar.

As a next step, the assembled tiles Pr are cut into sections SPi having various geometrical shapes such as triangular, trapezoidal, rectangular etc. The sections SPi are then magnetized and assembled into magnet forming elements EFM. The magnet forming elements are tuned to further remove magnetic field non-uniformities and then assembled into magnets. As one aspect of the invention, the finished magnets may be tuned to further enhance the uniformity of the magnetic field generated by the finished magnet.

BRIEF DESCRIPTION OF THE DRAWINGS

These and other features and advantages of the present invention will become apparent when the following detailed description of the invention is read in conjunction with the accompanying drawings, in which:

FIGS. 2*a*–2*g* illustrate the main steps of the method of the invention;

DETAILED DESCRIPTION OF THE PREFERRED EMBODIMENTS

Figure 1:
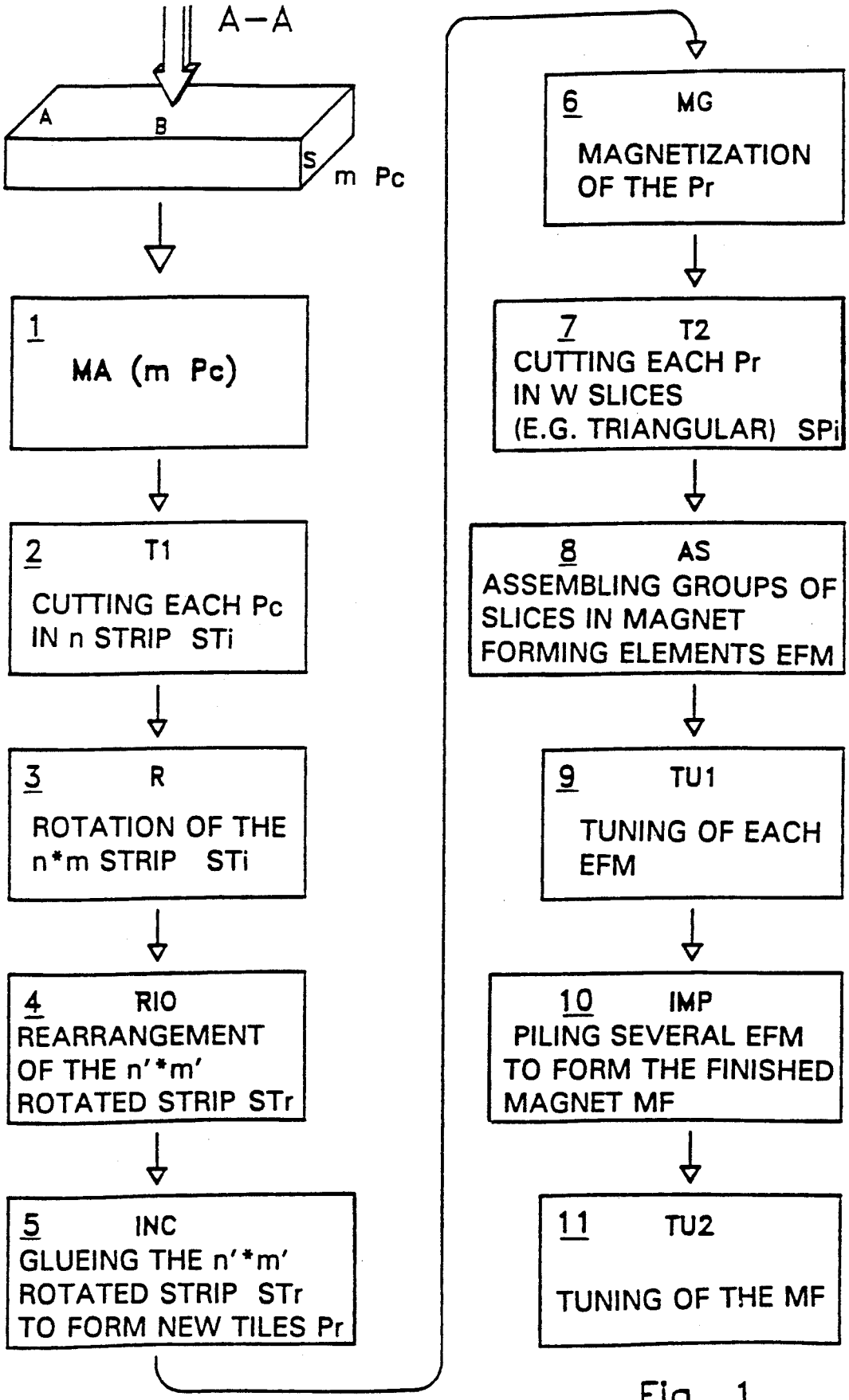
FIG. 1 is a flow diagram of the method of the invention.
Figure 2A:
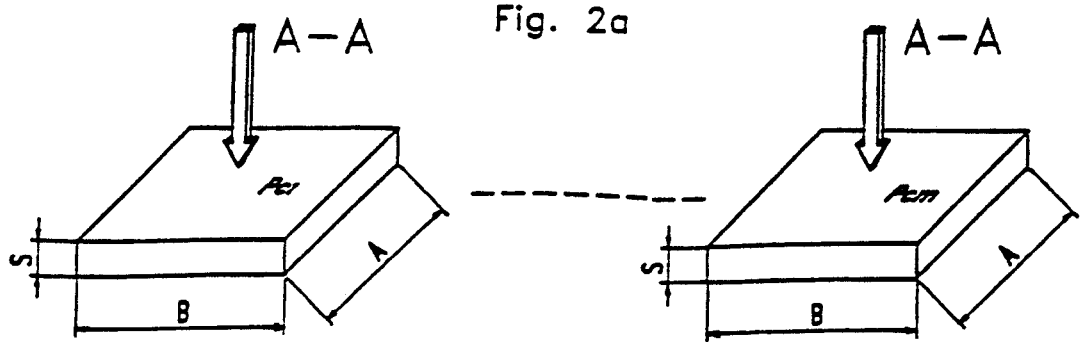
Figure 2B:
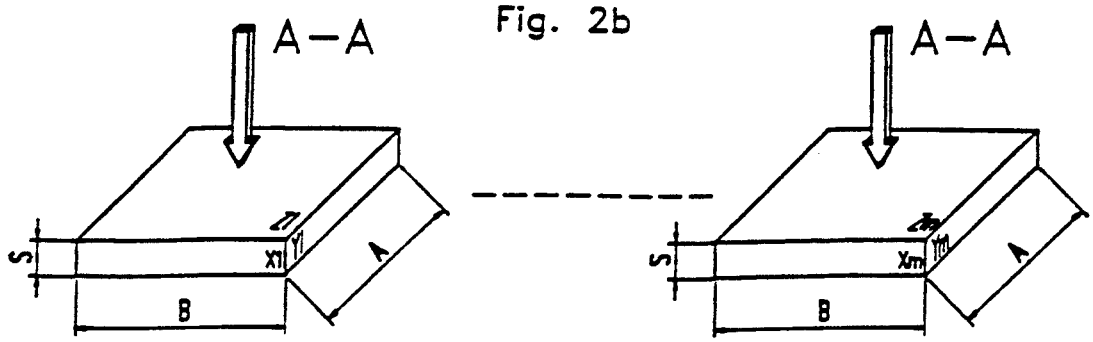

Referring now to the drawings wherein like numbers indicate like elements, there is shown in FIG. 1 a flow diagram of the various steps in manufacturing magnetic field generators in accordance with the principles of the invention. Referring to FIG. 2*a* and 2*b*, one and in general m commercial tiles Pc of magnetic material enter step 1 for marking MA with an identification code Z.

The conventional tiles Pc are defined in terms of length A and width B, both perpendicular to the A—A axis, and in terms of thickness S along the A—A axis. (FIG. 2*a*). The A—A axis can be coincident with an anisotropy axis.

Figure 2C:
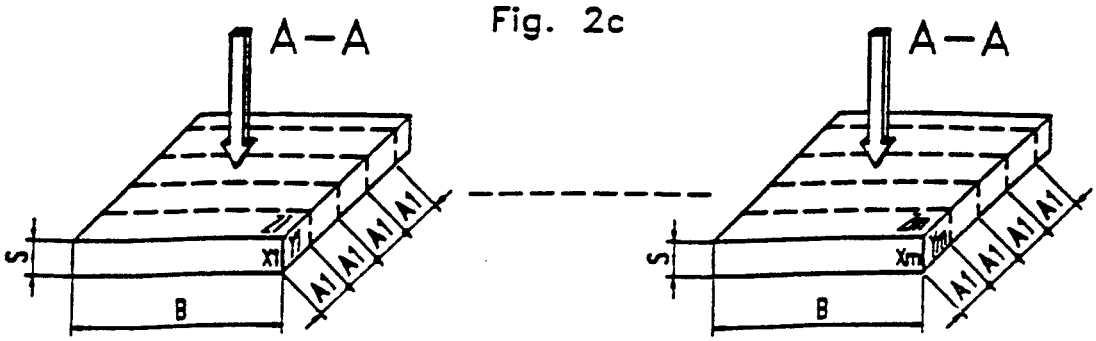

The tiles Pc after marking MA undergo, in step 2, a cutting operation T1, thereby obtaining from each tile Pc n strips STi. (FIG. 2*c*). The strips STi have the same width B and thickness S as the tiles Pc, and a new length Al, determined by the formula:

$$Al = \frac{A - k}{n}$$

where k is the possible wasted material and n is a generic positive integer.

As is evident from the above formula, the length Al is a flexible parameter that can be chosen according to the particular circumstances. This flexibility is important for the process and is used to minimize the effects of the length of the magnet. This aspect of the invention is described in the prior art literature.

In the present case, the particular length of the sections used to build the magnet is obtained using mathematical calculations intended to optimize the magnetic field properties of the finished magnet. Furthermore, since the sections obtained in step 2 are utilized to produce finished magnets having gaps of predefined width, as shown in FIG. 3*c*, the advantage of being able to choose with total freedom the length of the magnet forming elements derived from the process is significant.

As previously explained, the set of input tiles Pc can have a cardinality m, thereby resulting in strips STi at the output of step 2 having a cardinality n * m; each strip being identified by means of the marking MA carried out in step 1. The n * m strips STi after the cutting operation in step 2 are rotated in step 3. The rotation R is at an angle such that the A—A axis falls in a position different from that of the original tile Pc. In a preferred embodiment, there is a 90° rotation of the A—A axis. FIGS. 2*d* and 2*e* represent step 3.

The rotation in step 3 is followed by rearrangement (RIO) in step 4. Referring to FIG. 2*f*, the n * m rotated strips STr are grouped in sets of n' strips each. The groups are formed according to the individual marking, and criteria that guarantee the desired symmetry and error compensation characteristics in the final assembly. Similarly, the order of the n' strips that make up the group is established.

The rearrangement process in step 4, together with the initial choice of parameters n and m, results in the required symmetry characteristics in the assembly of the final magnets, and the desired reduction in errors arising from the imperfect nature of the initial tiles Pc.

The rotated and rearranged strips STr of step 4, are joined in step 5 using suitable means such as gluing to obtain p new tiles Pr. Each new tile is made up of n' strips STr individually marked and placed in a proper predefined sequence. The new tiles Pr have width B, thickness Sr=Al (both perpendicular to the rotated A-Ar axis) and a new length n' * s, parallel to the A-Ar axis. (FIG. 2*f*). The number of strips n' that form a group may vary from one group to another.

According to the invention, the tiles Pr have the desired characteristics of symmetry, and compensation for the magnetic property variations in the conventional tiles Pc utilized in the process for the manufacturing of the permanent magnetic field generators. In this manner, the errors and dissymmetries commonly found in permanent magnetic field generators deriving from the variations in the characteristics of the magnetic material used in the manufacture are removed.

Figure 2G:
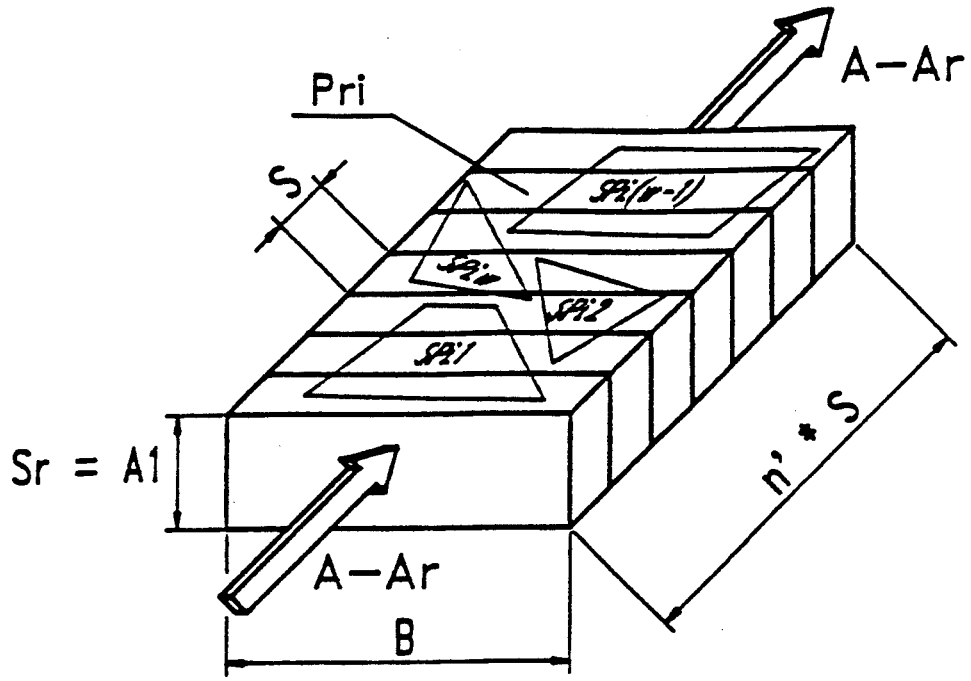

During steps 6 and 7 (that can also be carried out in reverse order), the tiles Pr of step 5 undergo a magnetization process MG and a second cutting operation T2. By these two operations, it is possible to get w magnetized sections SPi having various geometrical shapes such as, triangular, trapezoidal, rectangular etc. (FIG. 2*g*).

In step 8, the portions or sections SPi obtained in the second cutting operation T2, are assembled into magnet forming elements EFM. The magnet forming elements EFM are formed by juxtaposing groups of sections SPi. Optionally, each magnet forming element may undergo, in step 9, a tuning process TU1 to reduce the errors cumulated so far.

In step 10, several magnet forming elements EFM are stacked in order to form the finished magnet MF. Optionally, the finished magnets MF may undergo, in step 11, the final tuning TU2.

According to one aspect of the invention, it is possible to produce magnet forming elements EFM having different shapes and dimensions. The magnet forming elements EFM are produced based on the application requirements by arranging sections SPi, obtained in step 6 and 7, having different shapes and different orientations of the A—A axis.

Figure 3A:
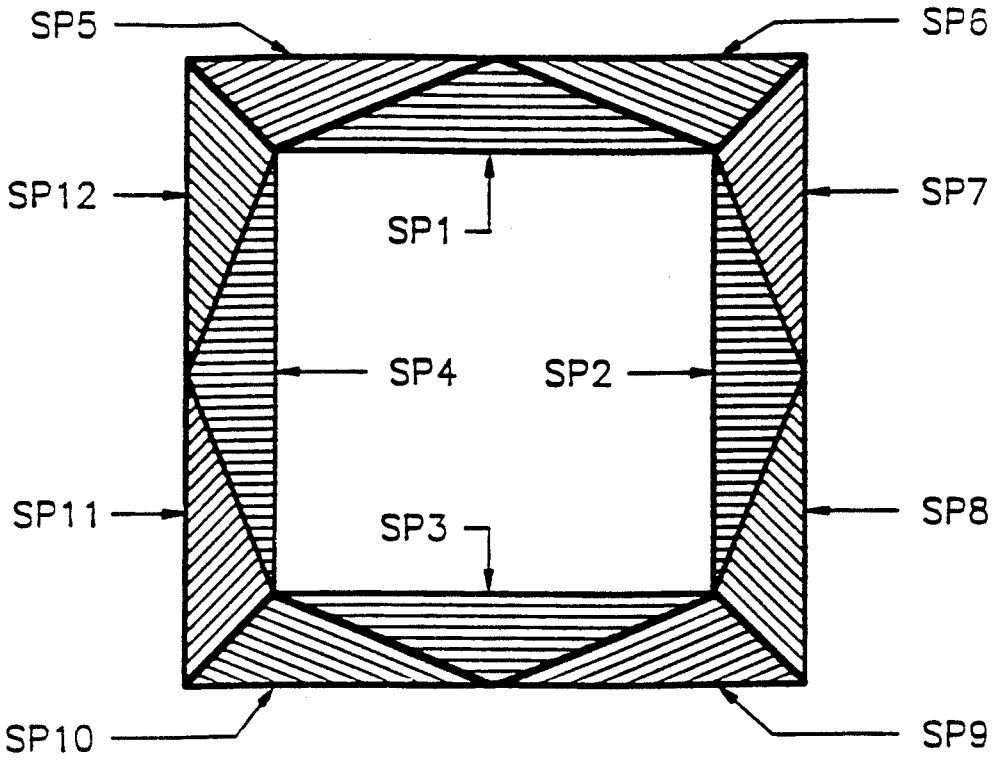
FIGS. 3*a*–3*c* show some new magnet shapes that are possible with the magnet forming elements obtained by the process of the invention.
Figure 3B:
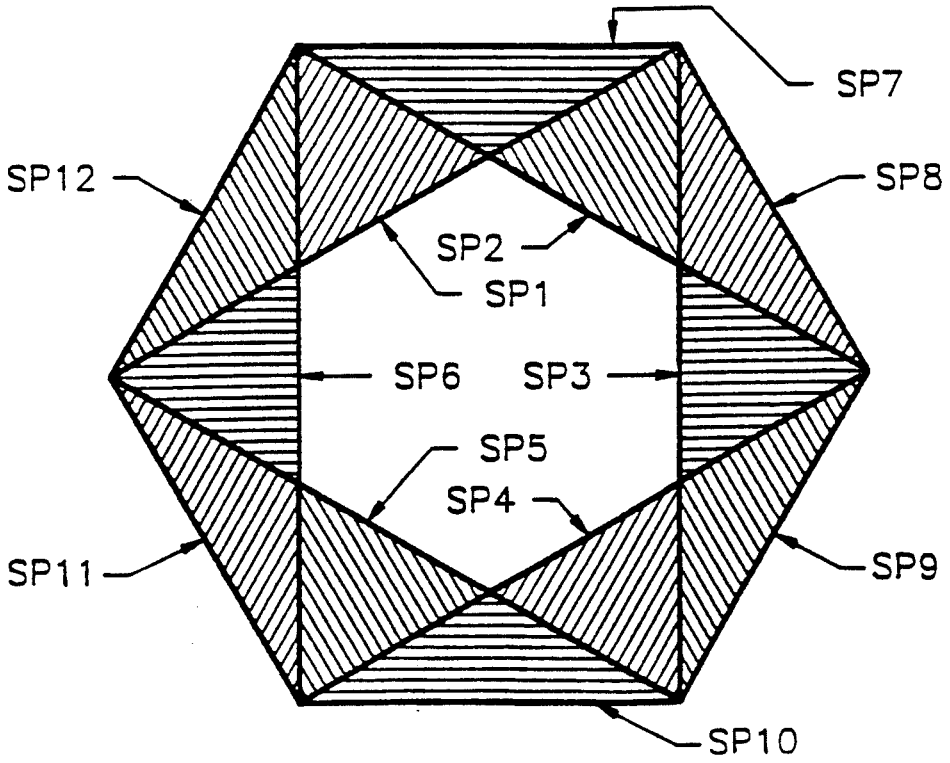
Figure 3C:
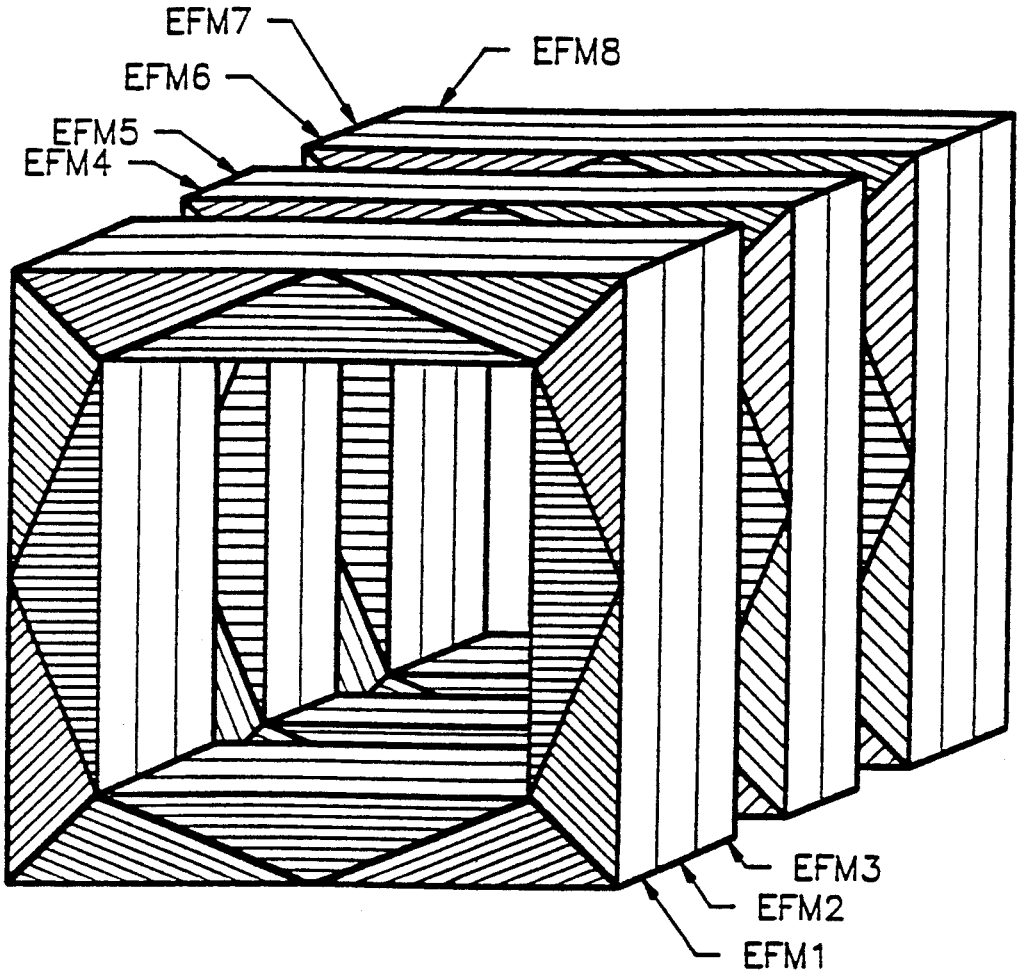

FIGS. 3*a* and 3*b* show two examples of magnet forming elements EFM having 4 or 6 sides or faces. On each side are arranged 3 sections. As a further option, some of the polygonal sections shown in FIGS. 3*a* and 3*b* can be identical. For example in FIG. 3*a*, SP1 can be equal to SP3 and SP2 equal to SP4. Similarly, in FIG. 3*b*, SP1 equals SP2 and SP8 equals SP12.

Hence, by adjusting the dimensions, angles, orientations, magnetization, number of segments of strips involved in the forming of each section, etc., it is possible to achieve a high degree of flexibility and modularity in the magnet forming elements and therefore in the assembly of magnets. As a result, magnets can be produced having the geometry, structure, field intensity, etc., necessary to meet all kinds of requirements. Furthermore, it is possible to optimize the characteristics, economy, efficiency and reliability of the finished magnets.

FIG. 3*c* shows a magnet formed by elements EFM1 to EFM8 having modularity. FIGS. 4*a* to 4*c*, 5*a* and 5*b* show magnets provided with a yoke G. The yoke is total in FIGS. 4*a* to 4*c*, and partial in FIGS. 5*a* to 5*b*.

Figure 4A:
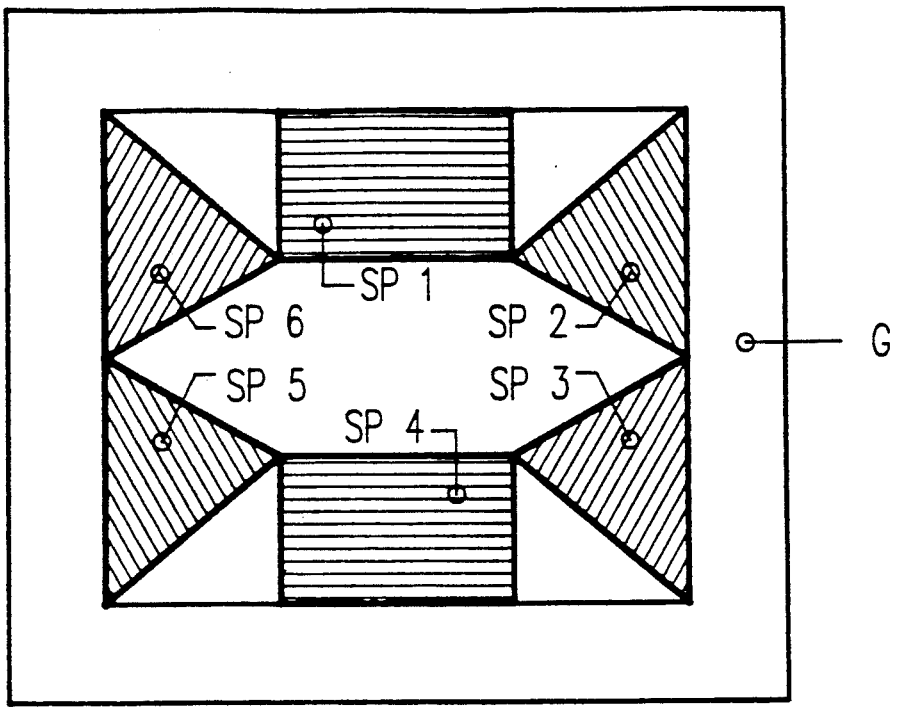
FIGS. 4*a* and 4*c* show totally yoked magnetic generators.
Figure 4B:
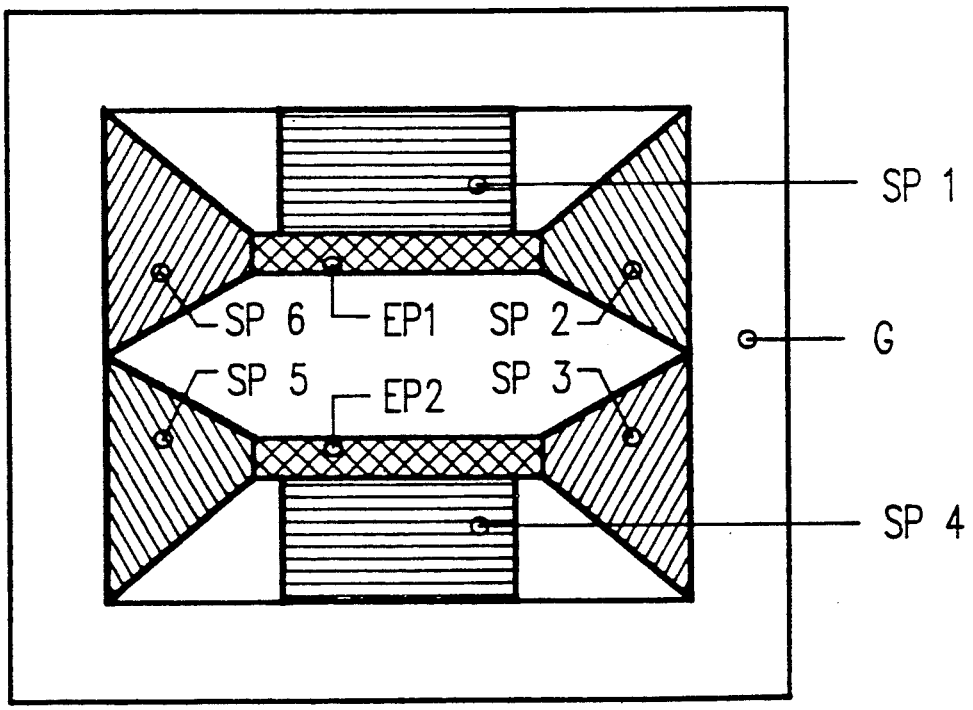
Figure 4C:
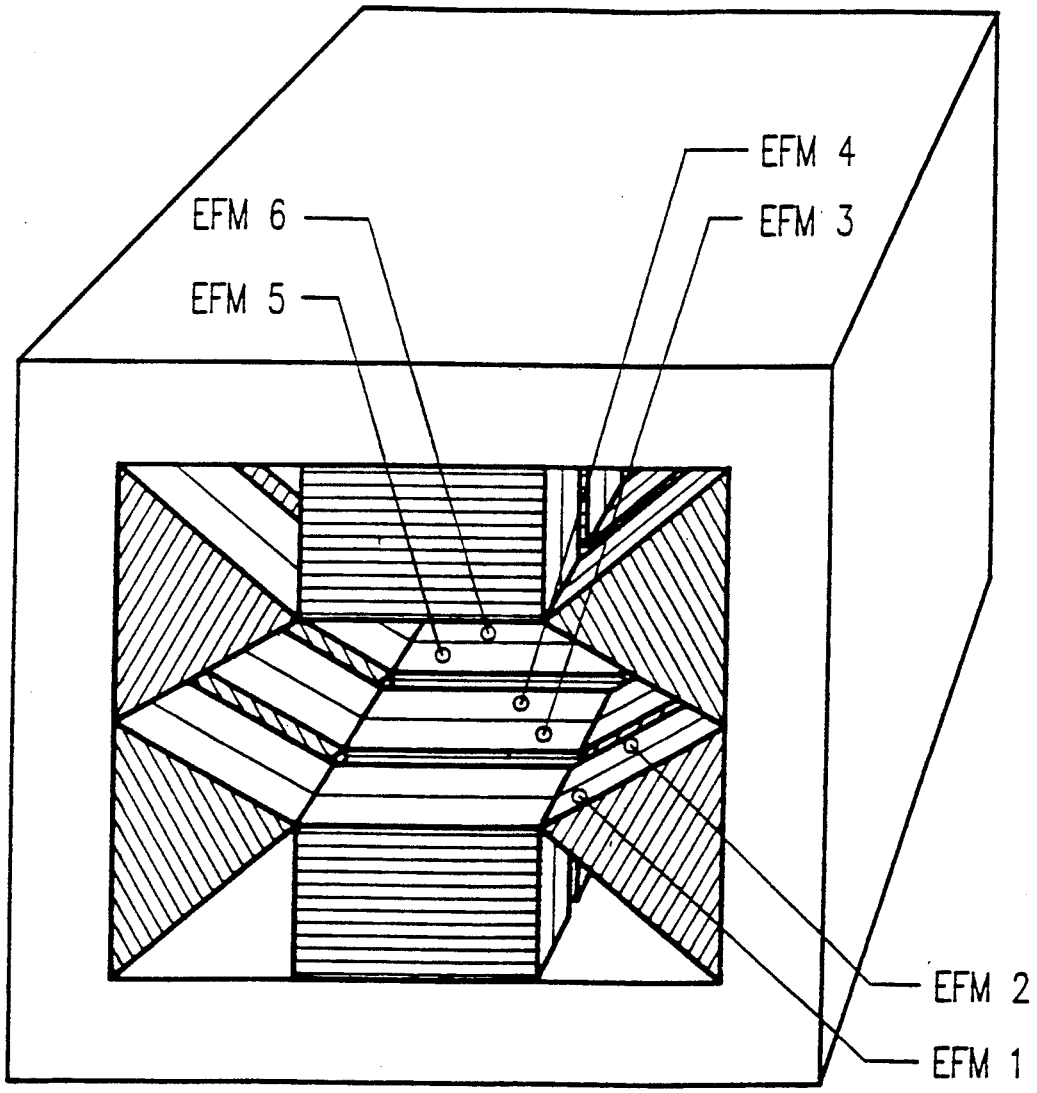
Figure 5A:
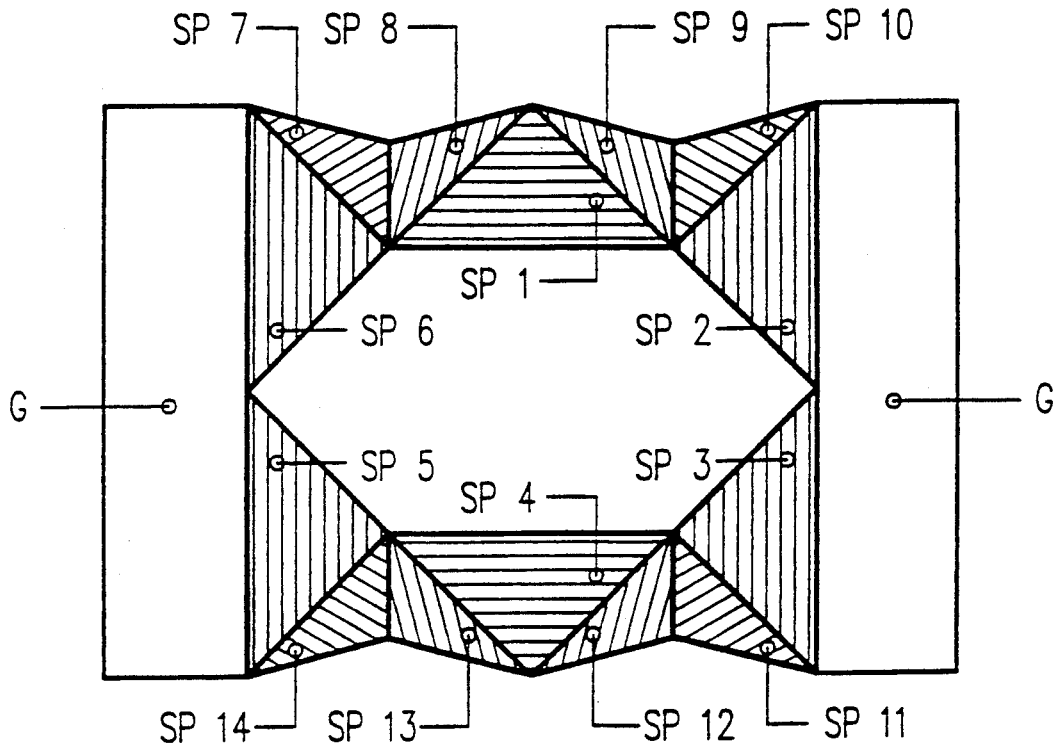
FIGS. 5*a* and 5*b* show partially yoked magnetic generators.
Figure 5B:
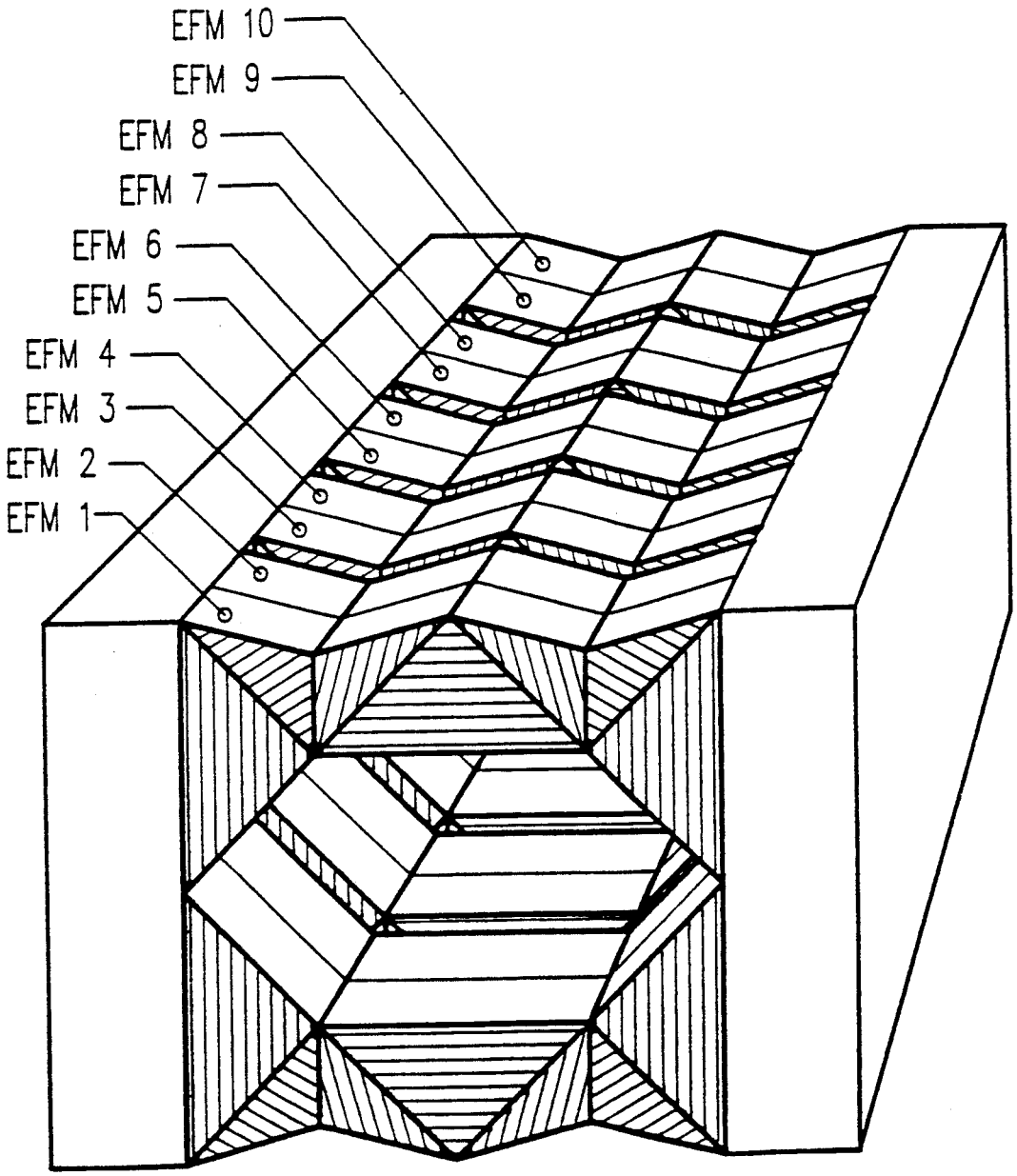

In FIG. 4*a*, the central cross-section cavity is hexagonal-shaped surrounded by magnetic material sections SP1 to SP6. FIG. 4*b* shows the same field generator structure of FIG. 4*a* provided with two polar expansions EP1 and EP2. FIG. 4*c* is a perspective view of the structure in FIGS. 4*a* and 4*b*, emphasizing the structure obtained by simply arranging the magnet forming elements EFM1 to EFM6. FIGS. 5*a* and 5*b* show, respectively, a cross-section and a perspective view of a generator formed from sections SP1 to SP14 with yoke G only on the side faces.

Though the invention has been described with reference to the preferred embodiments represented in the drawings, it should nevertheless be understood that many other variations and modifications will now become apparent to persons skilled in the art without departing from the scope of the invention. For example, the elimination of magnetic characteristic disuniformities can be carried out by cutting the tile up- or downstream of step MA. Therefore, it is preferred that the present invention not be limited by the specific disclosure herein, but only by the appended claims.

What is claimed is:

1. A process for manufacturing magnetic field generators, comprising the steps of:

(a) marking at least one conventional tile of magnetic material;

(b) cutting the marked tile or tiles into strips;

(c) rotating the strips;

(d) selecting the rotated strips from symmetrical positions of the conventional tiles and rearranging said rotated strips to place them, upon assembly in step (e), in symmetrical positions of new tiles whereby a compensation of the magnetic variations in the conventional tiles is obtained;

(e) assembling the rotated strips to form said new tiles;

(f) cutting the assembled tiles into sections;

(g) magnetizing said sections;

(h) assembling said sections into magnet forming elements; and (i) assembling the magnet forming elements to obtain magnets.

2. The process as recited in claim 1, wherein the conventional tiles of magnetic material have a parallelepipedal shape comprising length A, width B, thickness S, and an anisotropy A—A axis is perpendicular to the major surfaces A-B and parallel to S; and wherein in step (b), the strips retain the same width, thickness and orientation of the A—A axis of the conventional tile marked in step (a).

3. The process as recited in claim 1, wherein in step (c) the strips are rotated 90° around an axis perpendicular to an anisotropy A—A axis.

4. The process as recited in claim 1, wherein in step (e) the rotated strips are assembled by gluing.

5. The process as recited in claim 1, wherein in step (f) the assembled tiles obtained in step (e) are cut into sections having polygonal shapes preferably selected from among triangular, trapezoidal and rectangular.

6. The process as recited in claim 1, wherein the magnet forming elements obtained in step (h) are tuned before the assembly in step (i); and wherein the magnets obtained in step (i) are also tuned.

7. The process as recited in claim 6, wherein either of the tuning steps is absent.

8. The process as recited in claim 1, wherein the rotation in step (c), and the rearrangement in step (d), and the assembling in step (e) are carried out simultaneously.

9. The process as recited in claim 1, wherein step (g) and step (f) are carried out in reverse order.

* * * * *